US009498041B2

(12) United States Patent
Peterson

(10) Patent No.: US 9,498,041 B2
(45) Date of Patent: Nov. 22, 2016

(54) COSMETIC PALETTE WITH SELECTION MECHANISM FOR ACHIEVING A PREDEFINED LOOK

(71) Applicant: Kara Peterson, Los Angeles, CA (US)

(72) Inventor: Kara Peterson, Los Angeles, CA (US)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

(21) Appl. No.: 13/765,534

(22) Filed: Feb. 12, 2013

(65) Prior Publication Data

US 2014/0224275 A1 Aug. 14, 2014

(51) Int. Cl.

*A45D 33/00* (2006.01)
*A45D 40/24* (2006.01)
*A45D 44/00* (2006.01)

(52) U.S. Cl.

CPC ..... *A45D 33/006* (2013.01); *A45D 40/24* (2013.01); *A45D 44/005* (2013.01)

(58) Field of Classification Search

CPC .. A45D 33/006; A45D 33/008; A45D 33/18; A45D 40/22; A45D 40/24; A45D 44/005; A45C 11/008

USPC ..... 132/294, 286, 303, 314, 315; 434/98, 434/100; 206/581, 235, 823

See application file for complete search history.

(56) References Cited

U.S. PATENT DOCUMENTS

| | | | | |
|---|---|---|---|---|
| 2,628,625 | A * | 2/1953 | Pike | 132/315 |
| 3,851,655 | A * | 12/1974 | Tarro | 132/294 |
| 4,160,271 | A * | 7/1979 | Grayson et al. | 700/90 |
| 4,561,850 | A * | 12/1985 | Fabbri et al. | 434/98 |
| 4,594,070 | A * | 6/1986 | Stoddard | 434/104 |
| 5,005,697 | A * | 4/1991 | Jimbo | A45C 13/02 132/294 |
| 5,236,365 | A * | 8/1993 | Badami | 434/377 |
| 5,441,412 | A * | 8/1995 | Hayles | 434/100 |
| 5,813,420 | A * | 9/1998 | Sussman | 132/294 |
| 6,338,349 | B1 * | 1/2002 | Robinson et al. | 132/200 |
| 6,631,806 | B2 * | 10/2003 | Jackson | 206/581 |
| 6,739,345 | B2 * | 5/2004 | Stanley, III | 132/200 |
| 7,165,559 | B1 * | 1/2007 | Goodman | 132/294 |
| D564,707 | S * | 3/2008 | Barresi | D28/83 |
| D632,015 | S * | 2/2011 | Lai | D28/83 |
| D651,351 | S * | 12/2011 | DeMarco | D28/84 |
| 2003/0034044 | A1 * | 2/2003 | Gubernick | A45D 44/005 132/294 |
| 2006/0110417 | A1 * | 5/2006 | Hamlin | 424/401 |
| 2006/0188850 | A1 * | 8/2006 | Mills | 434/100 |
| 2008/0245383 | A1 * | 10/2008 | Tomandl | 132/200 |
| 2010/0132734 | A1 * | 6/2010 | Mills | 132/294 |

FOREIGN PATENT DOCUMENTS

GB WO 9216124 A1 * 10/1992 ..... A45D 44/005

OTHER PUBLICATIONS

PCT International Search Report; International Application No. PCT/US2014/015552; Completion Date: Jun. 11, 2014; Mailing Date: Jun. 12, 2014.

PCT Written Opinion of the International Searching Authority; International Application No. PCT/US2014/015552; Completion Date: Jun. 11, 2014; Mailing Date: Jun. 12, 2014.

Web site: http://makeupspy.co.uk/blog/new-product-watch-2013; Jan. 14, 2013; p. 2.

* cited by examiner

*Primary Examiner* — Tatiana Nobrega
(74) *Attorney, Agent, or Firm* — Peter Giancani

(57) ABSTRACT

Combinations of one or more selector mechanisms and a cosmetic palette for advising a user on how to achieve specific cosmetic effects.

11 Claims, 7 Drawing Sheets

COSMETIC PALETTE WITH SELECTION MECHANISM FOR ACHIEVING A PREDEFINED LOOK

FIELD OF THE INVENTION

The present invention is directed to combinations of one or more selector mechanisms and a cosmetic palette, and methods of use thereof.

BACKGROUND OF THE INVENTION

When applied correctly, makeup is able achieve a seemingly endless range of "looks" on the same face. In cosmetics, a "look" is a distinct appearance that conveys personality, emotions, ideas, effects or any combination of these or other impressions. A look may convey personality, such as friendly, gentle, strong, passionate, professional, intelligent, shy or sexy, just to name a few. Some looks convey emotions, such as joy, sadness, lightheartedness, anger, fear, bravery, or laughter. Some looks may convey an idea, such as independence, youth or maturity. Achieving a desired look with makeup requires skill. The average cosmetic consumer does not have the skill required to achieve a look. Furthermore, fashion is fleeting and new looks come and go quickly. The average consumer does not have the time to keep up with how to achieve this season's preferred looks. Furthermore, for any given look, there are any number of variations. The same overall look may be achieved with different combinations of shades. The shades selected may depend on the skin tone and skin type of the user. So a user also needs help in determining the best variation of a look for her skin.

Some of the most sophisticated looks are achieved by placing different shades of cosmetic product on the skin. The shades may be located adjacent to one other or they may be blended together on the skin. In order to enable a cosmetic consumer to achieve specific cosmetic looks, cosmetic products in a multiplicity of colors may be sold in a single package, arranged side-by-side as a palette of colors. However, the use of multiple shades of cosmetic to achieve a desired look is not easy for a user with little experience. With just a few basic colors, the number of gradations of shade and tone that can be achieved may be overwhelming. The question of which shades to use, in what quantity, in what order to which part of the face is not readily apparent. The determination is a very creative process, and cosmetic consumers do not usually achieve the same level of results as a professional make up artists, or they might have difficulty duplicating a result. What is need is a combination makeup palette and selector tool that assists a cosmetic user in selecting a desired look, and the best variation of the look based on her own skin and features, and then guides the user in achieving that look. The present invention aids a consumer to achieve specific looks better and more consistently. It also enables her to try new looks with greater confidence.

OBJECTS OF THE INVENTION

In accordance with the foregoing a main object of the present invention is to provide a combination cosmetic palette and selector (or selection) mechanism that provides a consumer with reasonable number of variations of a predefined look that are considered cosmetically acceptable.

Another object is to significantly increase the chances that a consumer will be able to achieve a predefined look with professional results.

Another object is to enable a consumer to apply makeup to get a desired look, while allowing her to fine tune the look for her specific face and features.

SUMMARY OF THE INVENTION

The present invention comprises a strategic arrangement of a multiplicity of cosmetic products. It also comprises one or more product selector mechanisms for identifying a subset of products, and an indication of how to achieve a specific cosmetic effect or look. In preferred embodiments, the strategic arrangement comprises a surface with access to each product, i.e. a palette products. In preferred embodiments, the selector mechanism is one or more sheets or cards, each sheet or card comprising indicia and designed to interact with the palette to guide the consumer in the make up process.

DETAILED DESCRIPTION OF THE INVENTION

The invention comprises a palette (1) of viscous cosmetic products (1*d*) and at least one selector mechanism (2). By "cosmetic palette" or just "palette" we mean a multiplicity of viscous cosmetic products in a side-by-side arrangement. Viscous products may include hard and soft pressed powders, especially for the face and neck, and creamy lip and eye products. "Viscous" means that the product does not flow under its own weight (i.e. will not spill out its container under its own weight). "Side-by-side arrangement" means that the free surfaces of the viscous cosmetic products face the same direction. So, for example, in a double ended lipstick the tips of the two lipsticks do not face the same direction, and therefore, are not considered side-by-side. The arrangement of products is strategic, and designed to work with a selector mechanism (2) as herein defined.

Cosmetic Palette

Figure 1:
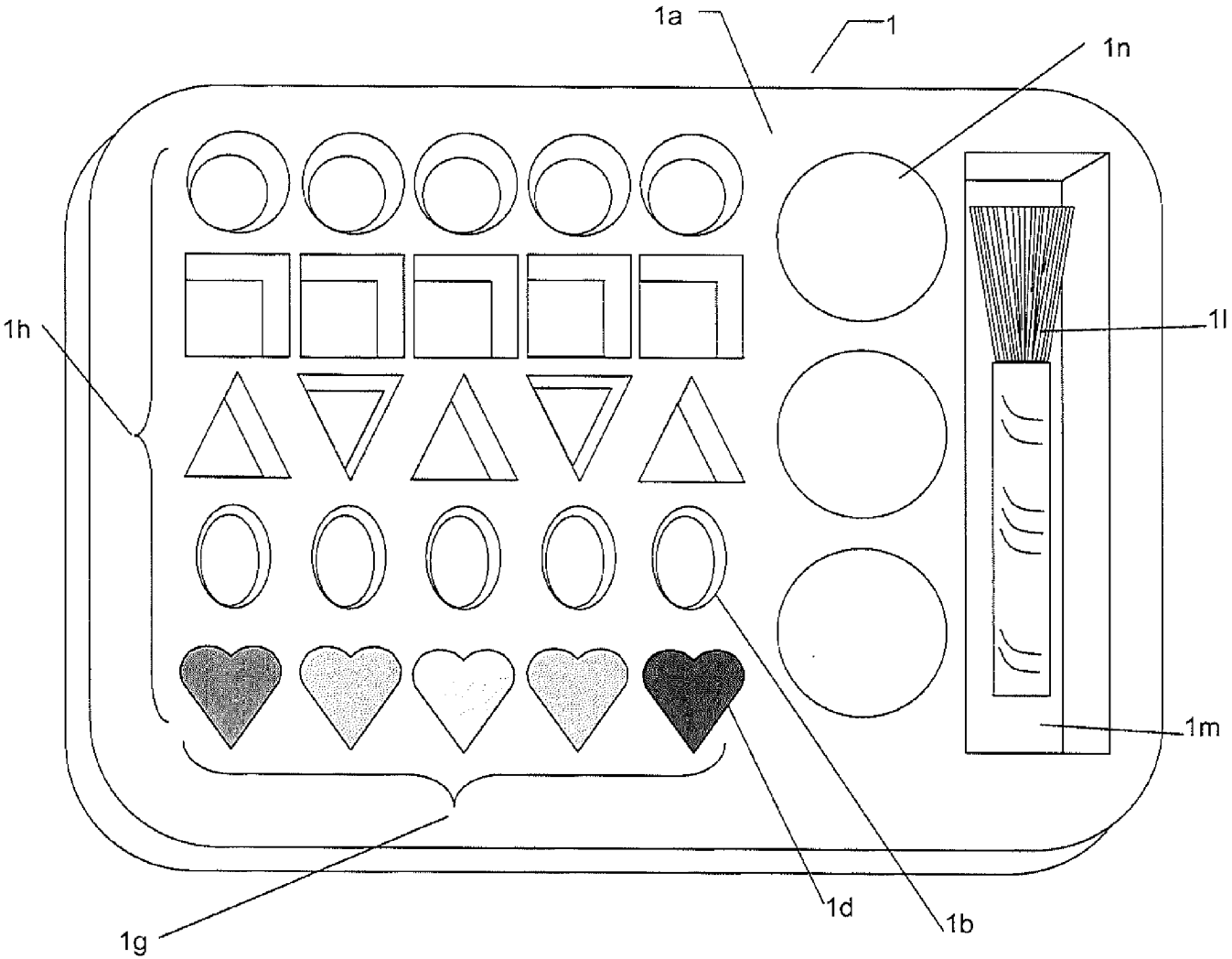
FIG. 1 is a perspective view of a first embodiment of cosmetic palette according to the present invention.
Figure 2:
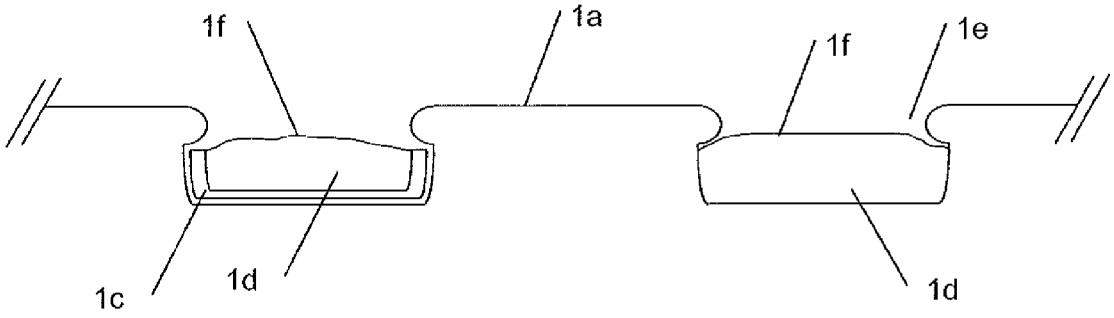
FIG. 2 is a cross section of a portion of a cosmetic palette according to the present invention.

Referring to FIG. 1, in preferred embodiments the cosmetic palette (1) comprises an essentially flat surface (1*a*) that supports or houses a multiplicity of cosmetic products (1*d*) in a side by side arrangement (1*f*, for example). The palette may be of any suitable construction, but in many embodiments molded plastic will be preferred. In some preferred embodiments, the flat surface of the palette has strategically arranged recessed portions (1*b*). Each recessed portion holds a cosmetic product. The products may be disposed directly into the recessed portions (shown on the right in FIG. 2), or the products may disposed in pans (1*c*), as is well known in the art, which are then disposed in the recesses (shown on the left in FIG. 2). The recesses are shaped to receive the pans. Preferably, the shape of each recess is complementary to the shape of the pan disposed therein. Preferably, means are provided to hold the pan in the recess, and prevent unintentional dislodging of the pan. For example, the pans may be glued into the recesses, or the pans and recesses may cooperate in a friction fitted or snap fitted engagement. For example, the opening (1*e*) of the recess (1*b*) may be slightly smaller than the pan (see FIG. 2). The pan can be forced through the opening into the recess, but will not back out unintentionally. The pans may be permanently mounted to the palette. This could be done by using high strength adhesive. Alternatively, the pans may be designed to be removable, perhaps to refill the pan or replace with a new pan. Replaceable pans may be achieved by using a lower strength adhesive or some suitable mechanical engagement between the pan and recess. For example, the opening (1*e*) of the recess (1*b*) may be slightly smaller than the pan. The pan cannot fall out of the recess unintentionally, but it could be removed from the recess if needed.

The pans (1*c*) and/or the recesses (1*b*) of the palette (1) may be any suitable shape. For example, cosmetic pans are typically round, rectangular (including square), triangular, oval, etc., as shown in FIG. 1. Alternatively, the pans may be non-regularly shaped or free form shapes. The shape of the pans and/or recesses may be chosen to efficiently utilize the space on the palette, and to achieve a desired arrangement of products. The sizes of the pans are typical of those used in cosmetic packaging. For reasons which will be made clear, in some preferred embodiments of the invention, the pans or recesses, as the case may be, are filled such that the free surface (1*f*) of the product does not rise above the level of the surface (1*a*) of the palette (1) (see FIG. 2). In other preferred embodiments this is not required.

The size of the palette is only limited by the ease of use of a consumer, and the number of products that a supplier wants to present to the consumer. The size of the palette is at least sufficient to accommodate four strategically arranged products, preferably at least eight, more preferably at least twelve strategically arranged products, most preferably at least twenty products. The products may be of the same kind, differing only in color or shade, or they may be of different kinds. For example, the palette may house one powder foundation product in twenty different colors or shades. Or, for example, the palette may house foundations, blushers, concealers, lipsticks, lip liners, eyeliners, eyeshadows, mascara products, or any other make up product that does not flow significantly under its own weight. The palette is such that a user is able to access the free surface of each product that is supported by the palette, with a suitable cosmetic applicator of those well known in the art.

Groups of Products

Preferably, the cosmetic products are strategically arranged into at least two groups. By "strategically arranged" we mean that the products within each group are sufficient to achieve one or more variations of the specified look, and the products within each group are positioned relative to each other so that a selection mechanism according to the present invention is able to identify specific subsets of products within a group. In some preferred embodiments, the products within each group are positioned relative to one another so as to permit rapid, successive access to any number of products within the group. Preferably, the product groups are visually obvious to a user, so that products in one group will be utilized without inadvertently engaging the products in a different group. For example, in FIG. 1, there are five groups of products. Each group is a row (1*g*) of products of the same shape. Alternatively, FIG. 1 could also represent five groups of products where each column (1*h*) of differently shaped products is a group. However, each product on a palette should belong to only one group.

The palette houses at least two groups of cosmetic products, preferably at least three groups, more preferably at least four group, and an increasing preference up to at least ten groups of products. Within each group, there must be at least two products. Preferably, most of the groups have the same number of products. Preferably, at least two of the groups have at least four products, more preferably at least two of the groups have at least five products, and an increasing preference up to at least eight products in the at least two groups.

Within the stated restrictions, four products would be arranged in two groups of two. Six products could be arranged in two groups of three or three groups of two, and so on. The chart below list some examples of the possible arrangements within the stated restrictions. The legend identifies the degree to which some preferred embodiments of a palette according to the present invention are preferred, within the stated restrictions.

| number of products strategically arranged on the palette | number of groups | number within each group | preferred rating |
|---|---|---|---|
| 4 | 2 | 2 | d |
| 6 | 2 | 3 | d |
| | 3 | 2 | c |
| 8 | 2 | 4 | b |
| | 4 | 2 | b |
| 9 | 3 | 3 | b |
| | 2 | 3/6 | b |
| 10 | 5 | 2 | b |
| | 2 | 5 | b |
| 12 | 4 | 3 | b |
| | 3 | 4 | a |
| | 2 | 6 | b |
| 20 | 4 | 5 | a |
| | 5 | 4 | a |
| 30 | 5 | 6 | a |
| | 6 | 5 | a |

d—acceptable
c—preferred
b—more preferred
a—most preferred

The Selector Mechanism

A selector mechanism (2) designed for use with the cosmetic palettes described herein, guides a user in the choice of products and shades, and instructs the user in the application of those products to achieve a specific "look". In general, each selector mechanism corresponds to a cosmetic "look". Each selector mechanism is able to identify one or more subsets of products within a group of products on the palette. Each subset of products identified by the selector mechanism corresponds to a variation of that look. The user is free to choose which variation she will implement.

Figure 3:
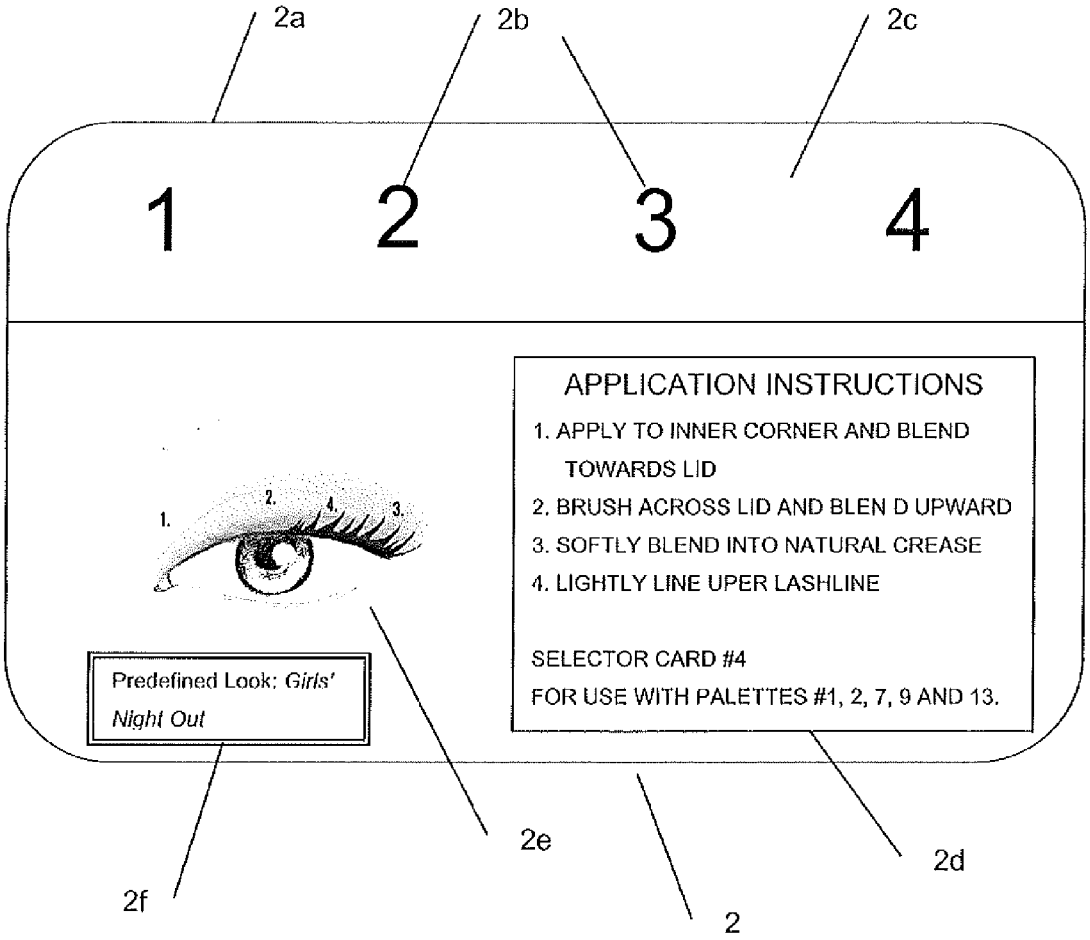
FIG. 3 shows one embodiment of a product selector mechanism for use with a cosmetic palette like that of FIG. 1.

In some preferred embodiments, the selector mechanism (2) is a flat card that can lay on top of the cosmetic palette (1) and be moved around on the palette. Referring to FIG. 3, the selector mechanism is a plastic card (2*a*) that has at least two indicia (2*b*). The number of indicia is equal to the number of products that will be used from the cosmetic palette to achieve the look indicated on the card. The indicia are positioned on the card such that when the card is placed on a specific group (1*g*) of products on the palette, each index is able to simultaneously register with a different product (1*d*) of that group. The indicated products define a subset of products that correspond to one variation of the desired look.

In FIG. 3, the indicia (2*b*) are the numbers 1, 2, 3 and 4. The indicia are spaced accordingly, so that each index unambiguously identifies one product (1*d*) on the palette (1). The products registered by the selector mechanism (2) should all belong to the same predefined group. For example, in FIG. 4, the user should not turn the card (2*a*) sideways. Doing so would create a subset of products from different groups, and in that case, the desired look would not be achieved. To dissuade a user from choosing products from more than one predefined group, instructions may be provided and/or the selector mechanism may be designed to register with the groups on the palette in only defined orientations.

Figure 4:
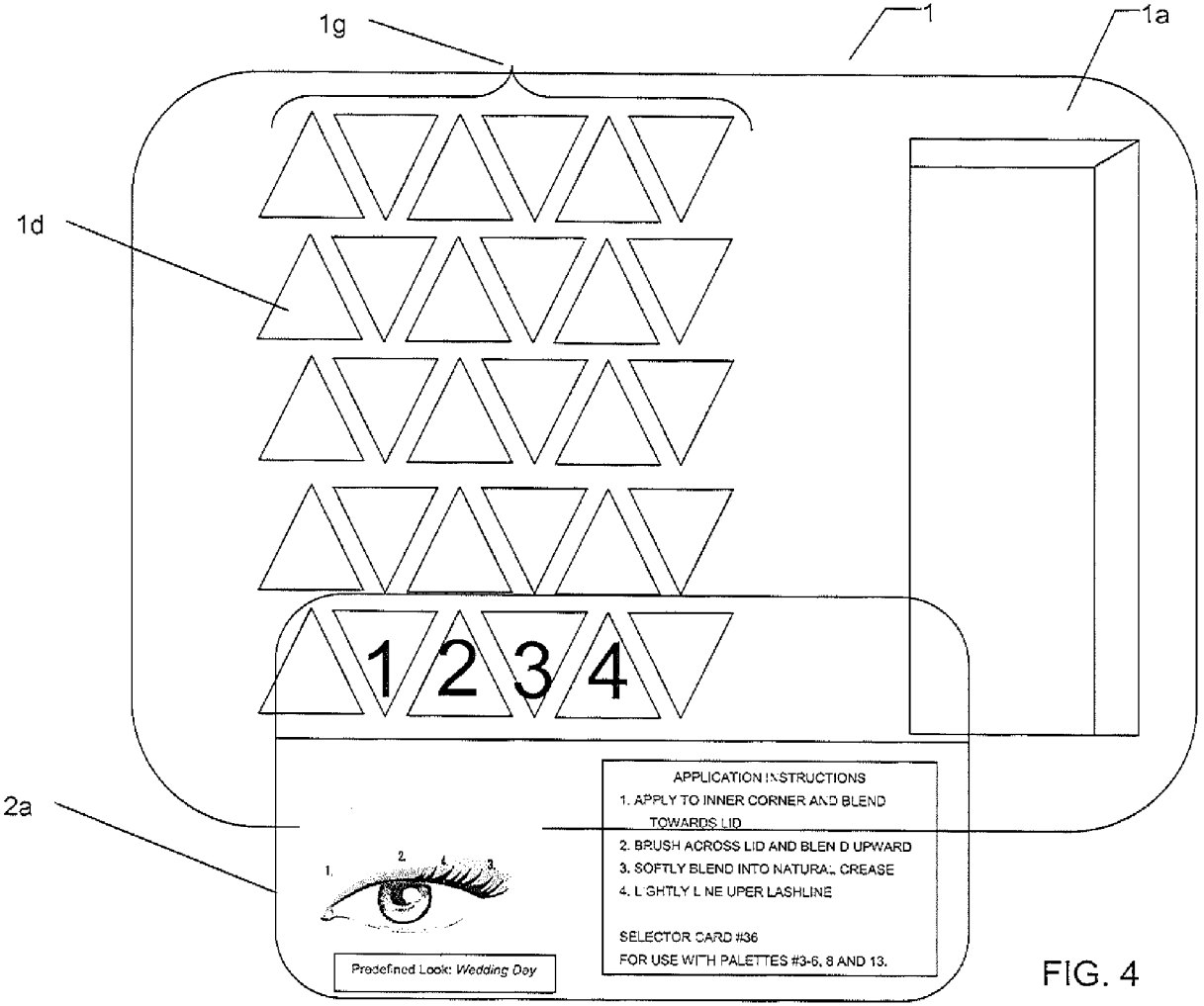
FIG. 4 shows a product selector mechanism similar to that of FIG. 3 in use with a cosmetic palette.

Preferably, the selector mechanism as so far described is transparent or has a transparent section. In FIG. 3, the indicia (2*b*) are located in a transparent section (2*c*) of the card (2*a*). This allows the card to be placed directly on top of the cosmetic products (1*d*) while allowing the user to see the shades. Placing the selector card directly on top of the cosmetic products is the main reason for not allowing the free surface (1*f*) of the products to rise above the surface (1*a*) of the cosmetic palette (1). The selector card in FIG. 4 is similar to that of FIG. 3, except that in FIG. 4 the entire card is fashioned of transparent material. In the palette of FIG. 4, each row of six triangular products is a group (1*g*), and there are five groups. The selector card (2*a*) has four indicia (2*b*), labeled 1, 2, 3 and 4. Therefore, within a group, a user may slide the card sideways to identify three variations (subsets) of the overall look. If she is not satisfied with those color combinations, she may slide the card up or down to move to a different group of products. In the figure, there are five groups of products, so fifteen total variations for achieving the desired look are offered by the palette and selector card shown in FIG. 4. For looks that require more or fewer products, the selector card will have more or fewer indicia. Providing the user with a reasonable number of variations allows her to fine tune the desired look for herself. Once the selector mechanism has been made to register with the cosmetic palette to the satisfaction of the user, the user is ready to apply the indicated products to achieve the look associated with or specified by the selector card.

In preferred embodiments of the present invention, the selector card (2*a*) or other selection mechanism comprises an indication of the predefined look that is achievable with that card (2*f*, for example), and provides instructions for applying the identified products to achieve the predefined look. These instructions may be text (2*d*, for example) and/or graphics (2*e*, for example). Instructions should include the order in which products are to be applied and the location to which they are applied. For example, in FIGS. 3 and 4, the indicia (2*b*) are numbers 1, 2, 3 and 4, which indicate the order of application. Preferably, the instructions include a graphic depiction of the body part being made up. The selector mechanism of FIG. 3 shows an eye (2*e*). The eye graphic is marked with numbers 1-4 to show exactly where to apply each product, and it also allows the consumer to see the specified look. Instructions on the selector card might also include an indication that the selector card is designed to be used with one or more particular palettes. The instructions might also suggest what applicator should be used to apply the makeup, and any other beauty tips.

Figure 5:
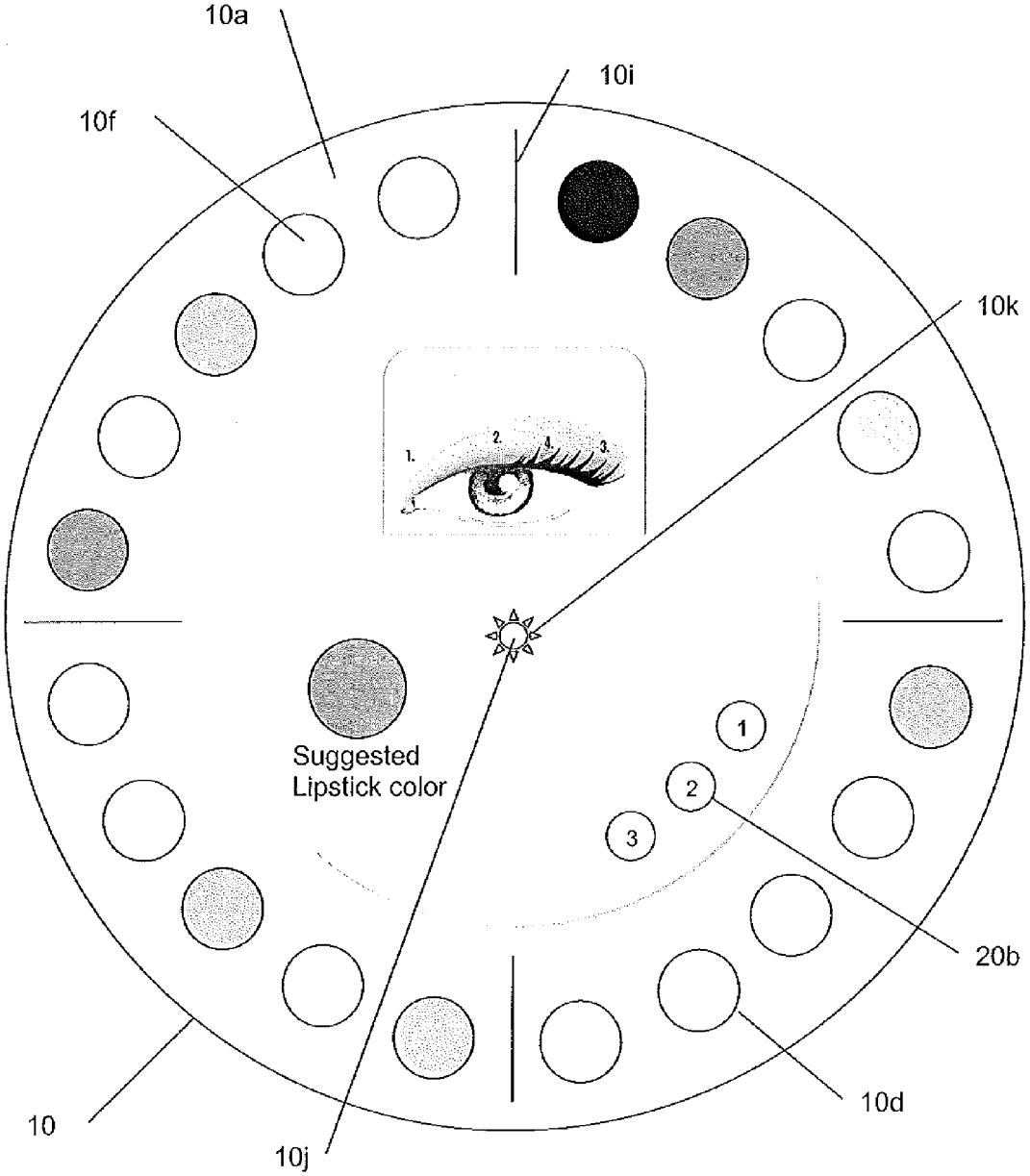
FIG. 5 shows one embodiment of circularly arranged palette and rotating selector mechanism.
Figure 6:
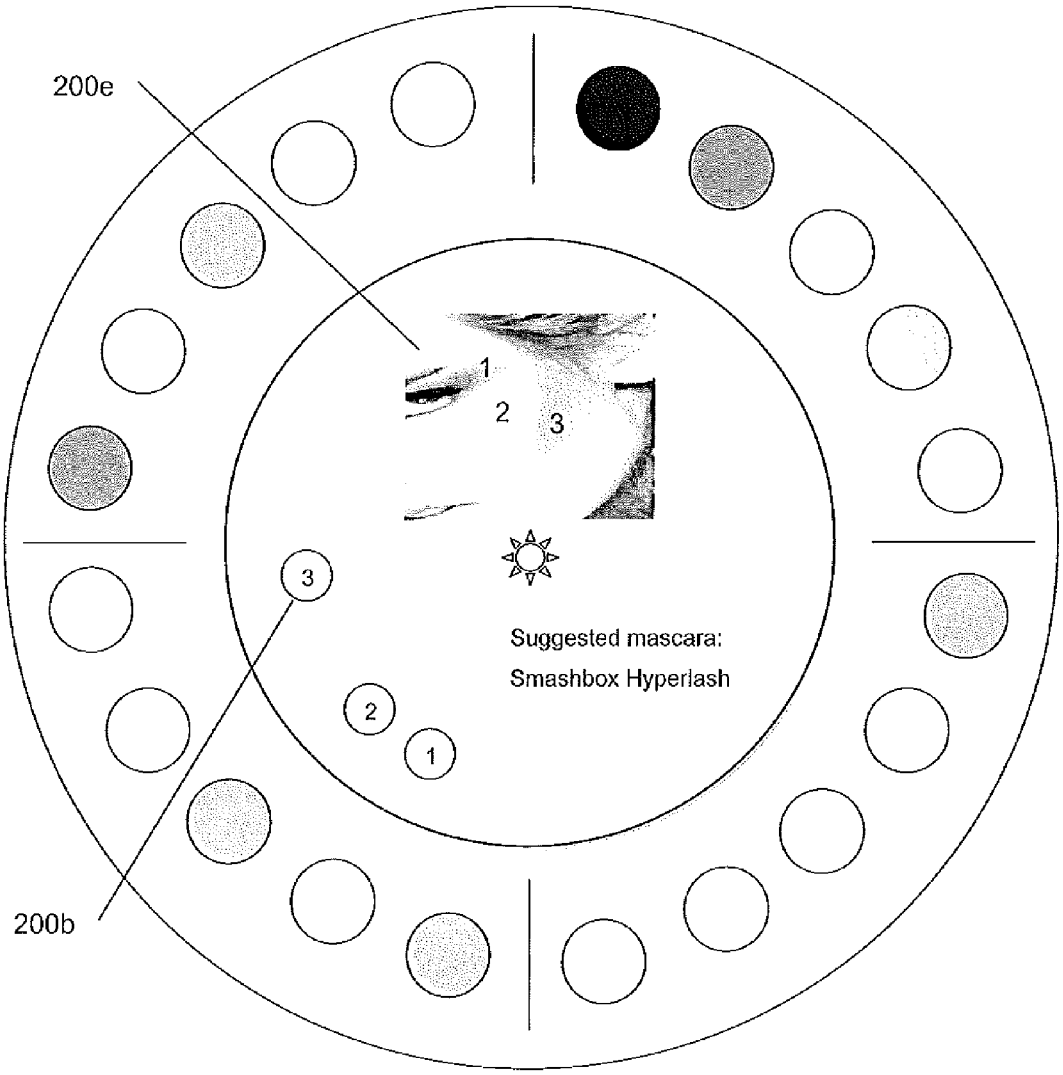
FIG. 6 shows a second embodiment of circularly arranged palette and rotating selector mechanisms.
Figure 7:
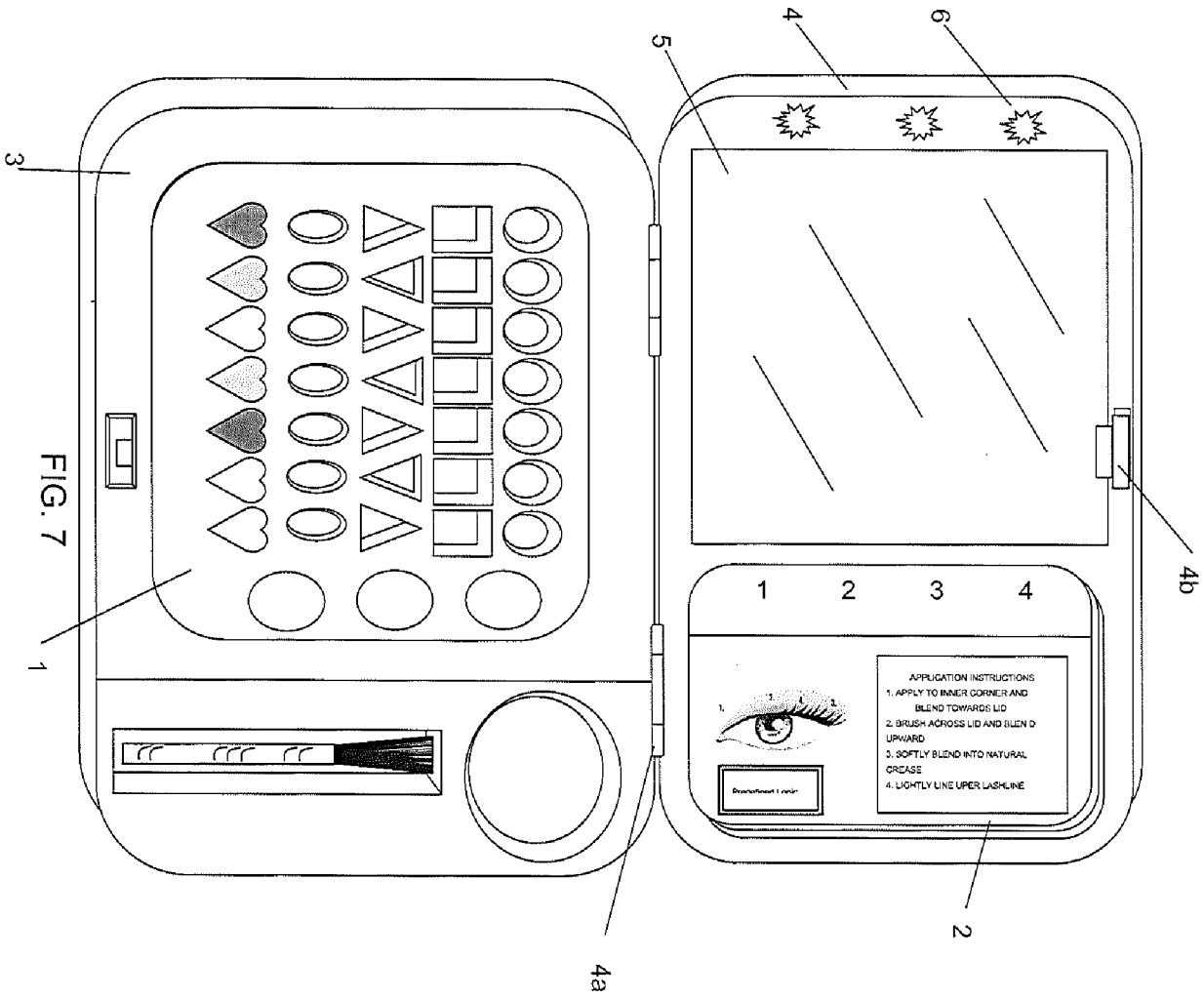
FIG. 7 shows a cosmetic palette according to the invention disposed in an optional base and having an optional cover and auxiliary items.

Although, in FIG. 4, the numbers 1-4 register adjacent products in left to right order, this is not required. The products that are needed to achieve a specific look may be spaced apart on the palette, and non-adjacent, depending on the layout of the palette. In that case, the selector card would be designed accordingly. Different cosmetic palettes and selector mechanisms are shown in FIGS. 5 and 6.

Since each selector mechanism corresponds to one predefined cosmetic look, preferred embodiments of the present invention comprise at least one cosmetic palette, and multiple different selector mechanisms. Multiple selector mechanisms that are designed for use with the same cosmetic palette form a set. All of the selector mechanisms within a set need not pertain to the same body feature. That is, some selector mechanisms may be for making up the eyelids, some for making up the cheeks, some the lips, some the eyelashes, etc. The combination of one cosmetic palette and at least one set of selector mechanisms is within the scope of this invention.

The combination of a palette and selector mechanism as disclosed herein, provides a significant advantage. By strategically arranging the products of the palette into groups, a user is directed to only those variations of a look that are considered cosmetically acceptable. For example, there are over 27,000 different ways to apply four products chosen from a palette of thirty products. However, in the embodiment of the present invention as shown in FIG. 4, a user is guided to just those fifteen combinations that are considered cosmetically acceptable. The chances of achieving the predefined, desired look with professional results are dramatically increased, virtually assured. The number of cosmetically acceptable variations will not always be fifteen, it depends on the number of products in the palette, the manner of grouping, and the size of the subset indicated by the selector mechanism, but the consumer will always be able to identify a reasonable number of variations with virtual assurance of achieving the look she wants. Having a reasonable number of variations of a look is another significant advantage. It would be possible to provide a consumer with just the three of four products required for one variation of a predefined look, but that one variation will not work best for all consumers. However, by giving the consumer a large number of products from which to choose, the process of achieving the a desired look became bewildering. The present invention is able to get the consumer the look she wants, while allowing her to fine tune the look for her specific face and features.

Some Alternative Embodiments

In FIG. 5 the products (10*d*) are circularly arranged. The palette (10) itself is also circular, but need not be. Dividing lines (10*i*) mark the boundaries between groups. Preferably, the center (10*j*) of the circular arrangement of products is marked in some way. The selector mechanism (20) lies on top of the palette and is concentric with the circular arrangement of products. In FIG. 5, the selector mechanism is shown as a flat disk, but it may be some other shape. The selector mechanism is enabled to rotate relative to the palette. For example, a pin or axle (10*k*) may pass through the palette and selector mechanism. The axle may be permanently attached to the palette, while different disks may be easily placed onto and removed form the axle. The selector mechanism has indicia (20*b*) that are able to simultaneously register with a subset of products within a group. The selector mechanism shown in FIG. 5 does not lay over the products on the palette. In this case, it may not be necessary to require the free surface (10*f*) of the product remain below the surface (10*a*) of the palette. A user may rotate the selector disk to identify the acceptable subsets of product that will create a predefined look. In this embodiment, written instructions are not provided on the selector mechanism itself, however, a suggested lipstick color that goes with the look, is provided.

FIG. 6 shows a second embodiment of circularly arranged palette and rotating selector mechanism. In this case, the indicia (200*b*) are such that the selected products are not all adjacent. The graphic element (200*e*) makes it clear that this selector mechanism is for making up the cheeks and outer eye.

Optional Components

Optionally, the palette may provide space for one or more storing auxiliary items (1*l*), such as a cosmetic applicator. a brush, a sponge, a mirror, etc. In FIG. 1, a recessed storage tray (1*m*) is provided. The palette may also house some additional personal care products (1*n*) which do not belong to any of the product groups in the palette, but which may by convenient to have in conjunction with achieving a desired look or simply for routine use. The additional products may or may not be color makeup products. They may be skin care products, such as a sunscreen product, moisturizer, makeup removal product, cleanser, etc.

Optionally, in some preferred embodiments of the present invention the cosmetic palette (1) is reposed in a base (3) and may or may not have a cover (4). The base and/or cover may provide space for housing auxiliary makeup items, such as one or more of the following: mirror (5), applicator, selector mechanism for use with the palette (1), cosmetic cleanser products, wipes, skin care products such as moisturizer, light sources (6), powers sources, such as batteries or capacitors, recharging means, etc. The light sources may be positioned to shine on the face of a user and/or on the palette. The cover, which fits over the palette to protect the palette when not in use, can be implemented to articulate with the base or with the palette or both. The cover may be hinged (4*a*) or not, and may have latch mechanism (4*b*) or not. In some preferred embodiments the cover is transparent so that the groupings and colors of the cosmetic products may be seen for their aesthetic impact. Also, the cover may provide an area that is suitable for decorating, or displaying indicia or labels.

Optionally, the base (3) and/or cover (4) are designed to house a set of selector cards (2). As new looks come into fashion, a consumer may supplement her set of selector cards. New selector cards may be provided by the retailer or manufacturer of the cosmetic palette, or by some other source. Optionally, selector mechanisms may be made available online. A user may visit a website from which it is possible to print or download for later printing one or more selector mechanisms. Once printed on paper, the selector mechanism could be used to identify the appropriate subsets of product that are needed to create the look.

What is claimed is:

1. A combination cosmetic palette and selection mechanism, wherein:

(a) the cosmetic palette comprises a flat surface housing cosmetic products in a side-by-side arrangement forming rows, wherein each row defines a group of cosmetic products useable together to create a cosmetic look, the cosmetic palette includes at least two rows of cosmetic products, each row having two to eight cosmetic products;

(b) the selection mechanism comprises a card that has:

an indication of a cosmetic look;

at least two cosmetic product indicia arranged side-by-side forming a row, where the indicia are spaced apart such that each index is able to unambiguously align with one product of a selected row of cosmetic products when the card is placed on the flat surface of the palette;

instructions indicating how to apply cosmetic products identified by the at least two cosmetic product indicia to achieve the cosmetic look, the instructions being provided as text, a graphic or a combination thereof, wherein the selection mechanism allows for different variations of the same cosmetic look to be achieved with the card by selectively aligning the cosmetic product indicia with different subsets of the cosmetic products by sliding the card in a horizontal direction along a selected row of cosmetic products or by sliding the card up or down in a vertical direction so long as each index is aligned with a cosmetic product of a single row of cosmetic products.

2. The combination of claim 1 wherein the instructions includes the order in which to apply the identified cosmetic products, and where to apply the identified cosmetic products.

3. The combination of claim 1 wherein the card comprises at least 4 cosmetic product indicia.

4. The combination of claim 3 wherein the card comprises a flat card, and the indicia are located in a transparent section of the flat card.

5. The combination of claim 1 wherein the flat surface houses at least twenty cosmetic products.

6. The combination of claim 5 wherein the flat surface houses at least four rows of at least four products.

7. The combination of claim 1 wherein the cosmetic products are disposed in recessed portions of the flat surface.

8. The combination of claim 7 wherein the cosmetic products are disposed in pans located in the recessed portions.

9. The combination of claim 7 wherein the cosmetic products do not rise above the level of the flat surface of the cosmetic palette.

10. The combination of claim 1 further comprising at least one additional selection mechanism wherein each selection mechanism corresponds to a different pre-defined cosmetic look.

11. The combination of claim 9 and further comprising a cover for the cosmetic palette, and wherein the cosmetic palette is reposed in a base.

* * * * *